US005785560A

United States Patent [19]

Akamatsu

[11] Patent Number: 5,785,560

[45] Date of Patent: Jul. 28, 1998

[54] IGNITION CABLE CONNECTION TERMINAL

[75] Inventor: Kunihiko Akamatsu, Shizuoka, Japan

[73] Assignee: Yazaki Corporation, Tokyo, Japan

[21] Appl. No.: 728,046

[22] Filed: Oct. 9, 1996

[30] Foreign Application Priority Data

Oct. 13, 1995 [JP] Japan ..... 7-265671

[51] Int. Cl.[6] ..... H01R 11/22

[52] U.S. Cl. ..... 439/851; 439/948

[58] Field of Search ..... 439/851, 843, 439/857, 852, 853, 948

[56] References Cited

U.S. PATENT DOCUMENTS

| | | | |
|---|---|---|---|
| 4,564,259 | 1/1986 | Vandame | 439/852 |
| 4,863,391 | 9/1989 | Mochizuki | 439/125 |
| 5,350,321 | 9/1994 | Takenouchi | 439/851 |

FOREIGN PATENT DOCUMENTS

| | | | |
|---|---|---|---|
| 26 14 210 | 10/1977 | Germany | 439/851 |
| 26 15 820 | 10/1977 | Germany | 439/851 |
| 64-2359 | 1/1989 | Japan . | |

*Primary Examiner*—Gary F. Paumen
*Assistant Examiner*—Tho Dac Ta
*Attorney, Agent, or Firm*—Morgan, Lewis & Bockius LLP

[57] ABSTRACT

In an ignition cable connection terminal, a band-like connection portion of a stopper piece portion extends from an edge of a fitting portion, and is folded back to extend in a direction of the axis of a connection terminal, and a body portion of the stopper piece portion is erected. A surface of the connection terminal is curved together with the fitting portion to thereby provide a curved surface which forms part of a cylindrical surface.

16 Claims, 4 Drawing Sheets

IGNITION CABLE CONNECTION TERMINAL

BACKGROUND OF THE INVENTION

The present invention relates to a connection terminal for an ignition cable, and more particularly to an ignition cable connection terminal for connecting an ignition cable, which supplies high-voltage current to an ignition plug of an engine, to a terminal of a distributor or the like.

An ignition cable connection terminal has heretofore been used to connect an ignition cable, which supplies high-voltage current to an ignition plug of an automobile engine, to a terminal of a distributor.

A conventional construction of that portion where an ignition cable is connected to a distributor will now be described with reference to FIG. 5. An ignition cable connection terminal 2, secured to a distal end of an ignition cable 1, is covered and insulated by a grommet 3 of insulative rubber mounted around an outer periphery thereof. When a distal end portion of the grommet 3 is inserted into a fitting recess 4*a* in the distributor 4, the connection terminal 2 is fitted on a mating terminal 5, and also a lock piece portion 6*a* on a resin housing 6 mounted on the grommet 3 is engaged with a jaw 4*b* of the distributor 4, thereby retaining the connection terminal 2 against withdrawal from the mating terminal 5.

Such an ignition cable connection terminal disclosed, for example, in Japanese Utility Model Unexamined Publication No. Sho 64-2359 will now be described with reference to FIGS. 6 and 7. The connection terminal 2 is formed by bending a metal (sheet) blank 10 stamped or blanked into a predetermined shape as described below.

A fixing portion 7 for clamping connection to the ignition cable 1 is formed at one end of the connection terminal 2, and a tubular fitting portion 8 for fitting on the mating terminal 5 is formed at the other end of the connection terminal 2. A stopper piece portion 9 for abutment against the distal end of the ignition cable 1 to position the same in the axial direction is provided between the fixing portion 7 and the fitting portion 8.

When the metal blank 10 is in a condition as shown in FIG. 7, the stopper piece portion 9 is formed integrally on a distal end portion of a connection portion 11 extending from a side edge 8*a* of the fitting portion 8 in perpendicular relation to the axis C. When the metal blank 10 is bent, the connection portion 11 is folded back on an inner peripheral surface of the tubular fitting portion 8 as shown in FIG. 6. The stopper piece portion 9 is upstanding at the distal end portion of the connection portion 11.

Three contact beads 12 are formed on and project radially inwardly from the inner peripheral surface of the fitting portion 8. When the fitting portion 8 fits on the mating terminal 5, the contact beads 12 are held in intimate contact with the peripheral surface of the mating terminal 5 since the fitting portion 8 resiliently embraces and holds the mating terminal 5 because of its spring action. Thus, the fitting portion 8 enhances the electrical contact, thereby achieving a good electrical connection between the ignition cable 1 and the mating terminal 5.

Recently, with the high-performance design of vehicles, parts have been densely housed within an automobile engine compartment, so that the available space within the engine compartment has become smaller, and the ignition cable connection terminal has been required to have a smaller-sized design so that space for arranging the ignition cable can be secured.

In the above conventional connection terminal 2 the connection portion 11 extends in contiguous relation to the inner peripheral surface of the fitting portion 8, and therefore the contact beads 12 must be provided at a section of the fitting portion 8 away from a position in the axial direction where the connection portion 11 is disposed. Therefore, the axial length L1 of the fitting portion 8 could not be reduced as shown in FIG. 7, and therefore the connection terminal 2 could not be reduced in the axial direction, and fails to have a smaller-sized design.

In the above connection terminal 2, since the fitting portion 8 resiliently embraces and holds the mating terminal 5 because of its spring action, the three contact beads 12 are held in contact with the peripheral surface of the mating terminal 5, and these contacts are point contacts. Therefore, when the vibrations of the engine are transferred to the connection terminal, or when the fitting portion 8 is deformed as a result of forcible attachment thereof to the mating terminal 5, there is a possibility that the contact between the contact beads 12 and the mating terminal 5 become incomplete.

Furthermore, in the above connection terminal 2, the fitting portion 8 is formed merely into a hollow, cylindrical shape and therefore when fitting the fitting portion 8 on the mating terminal 5 the tip of the mating terminal 5 is liable to be caught by the distal end of the fitting portion 8. This not only lowers the efficiency of the mounting operation, but also can deform the fitting portion 8.

SUMMARY OF THE INVENTION

The present invention has been made in view of the above problems, and an object of the invention is to provide an ignition cable connection terminal which is reduced in axial length to have a smaller-sized design, and has enhanced reliability of contact with a mating terminal, and can easily fit on the mating terminal.

The above object of the invention has been achieved by an ignition cable connection terminal formed by bending a metal sheet blank stamped into a predetermined shape. The connection terminal includes a fixing portion for a clamping connection to an ignition cable, a tubular fitting portion for coupling with a mating terminal, a stopper piece portion which is provided between the fixing portion and the fitting portion, and has a body portion for abutment against a distal end of the ignition cable. The stopper piece portion has a connection portion which extends in a direction of an axis of the connection terminal from an edge of the fitting portion remote from the fixing portion in an initial condition of the metal sheet blank, and the body portion is formed at a distal end of the connection portion. The connection portion is folded back at its proximal end, disposed at the edge of the fitting portion, on an inner surface of the fitting portion bent into a cylindrical shape, and extends toward the fixing portion.

A surface of the connection portion disposed within the fitting portion may be formed into a curved surface for intimate contact with a peripheral surface of the mating terminal.

A guide portion for guiding the insertion of the mating terminal into the fitting portion may be formed at a folded portion of the connection portion.

The connection portion is folded back at its proximal end, disposed at the edge of the fitting portion, on the inner surface of the fitting portion, and extends in the axial direction, and therefore when the fitting portion is fitted on the mating terminal, the connection portion is held in intimate contact with the peripheral surface of the mating terminal. With this intimate contact construction, the provision of the contact beads of the conventional terminal can be omitted, and the mating terminal is electrically connected to the ignition cable through the connection portion, the fitting portion which is formed into an integral construction with the connection portion, and the fixing portion. Since the provision of the contact beads on the fitting portion can be thus omitted, the axial length of the fitting portion can be reduced, and therefore the connection terminal can be formed into a smaller-size design.

The surface of the connection portion is formed into the curved surface for intimate contact with the peripheral surface of the mating terminal, and therefore the connection portion is brought into surface-to-surface contact with the mating terminal, thereby eliminating incomplete contact therebetween.

The guide portion is formed at the folded portion of the connection portion, and serves to guide the insertion of the mating terminal into the fitting portion, thus preventing the mating terminal from abutting against the edge of the fitting portion. Therefore, the connection terminal can be fitted on the mating terminal with a higher efficiency.

DETAILED DESCRIPTION OF THE INVENTION

Preferred embodiments of an ignition cable connection terminal of the present invention will now be described in detail with reference to the drawings.

Figure 1:
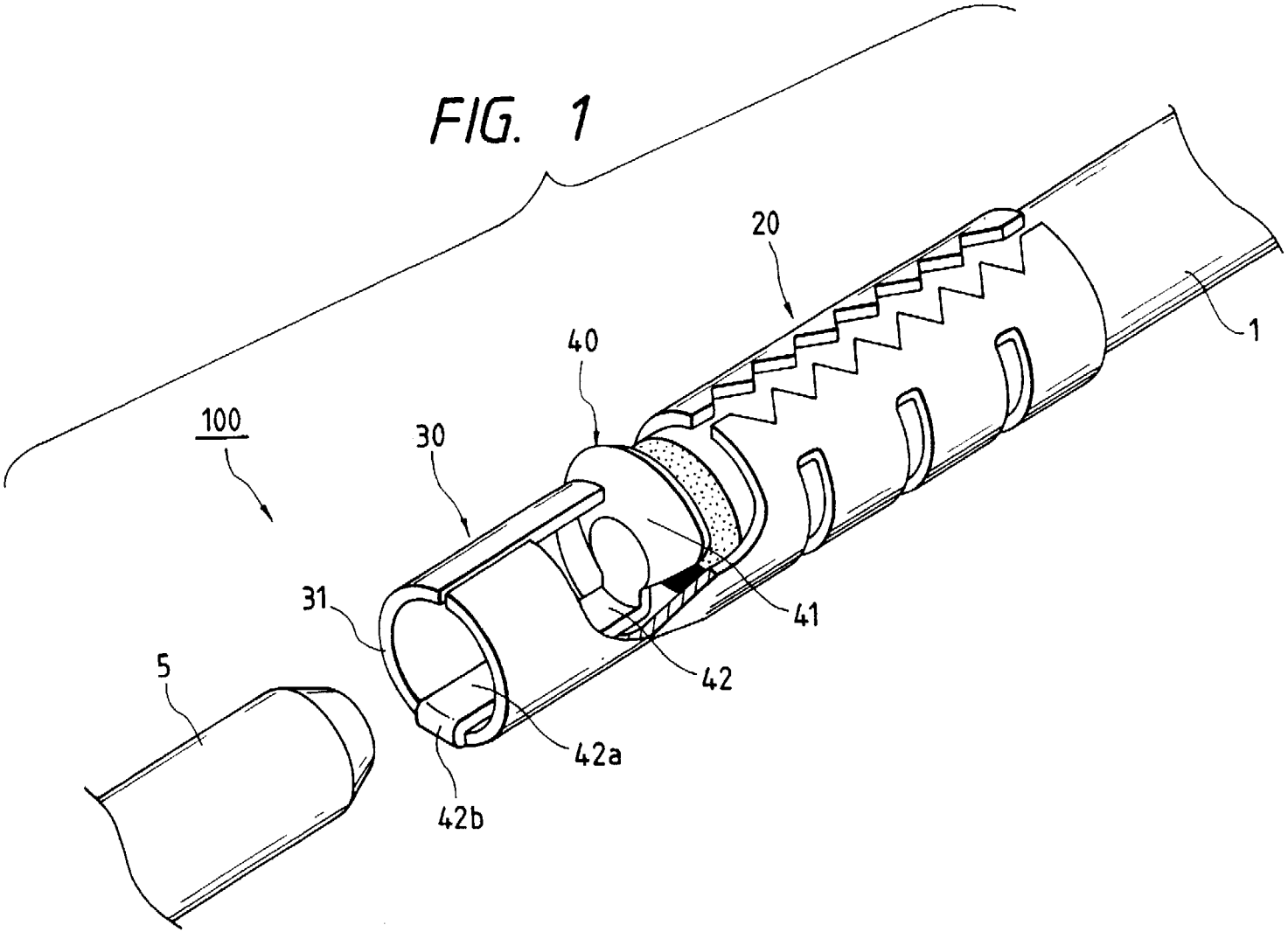
FIG. 1 is a partial, perspective view of one embodiment of an ignition cable connection terminal of the present invention.
Figure 2:
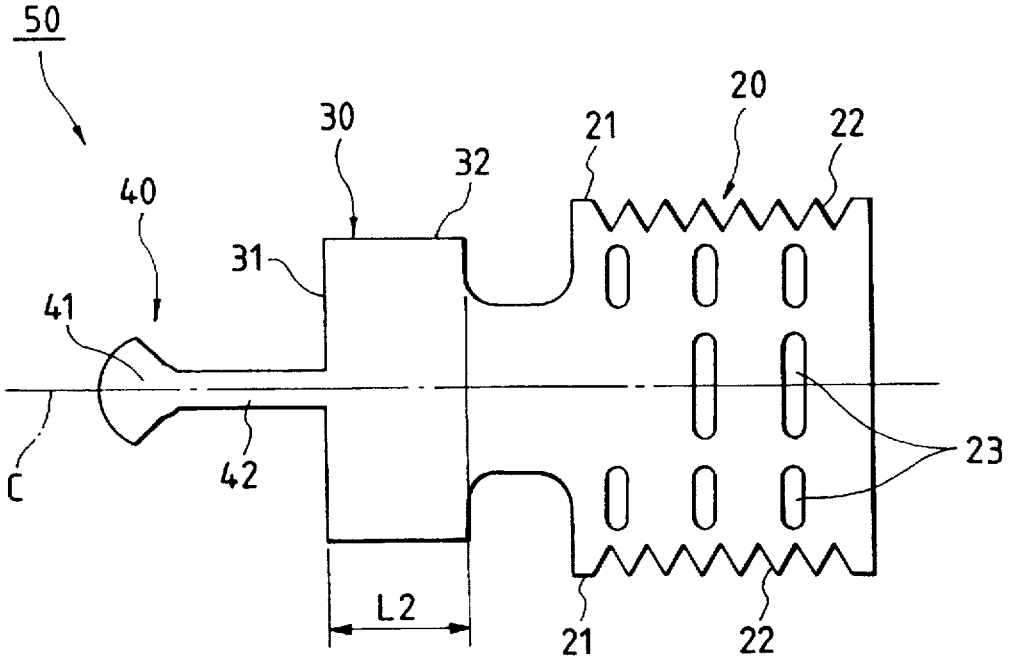
FIG. 2 is a developed view of a metal blank for forming the ignition cable connection terminal of FIG. 1.
Figure 3:
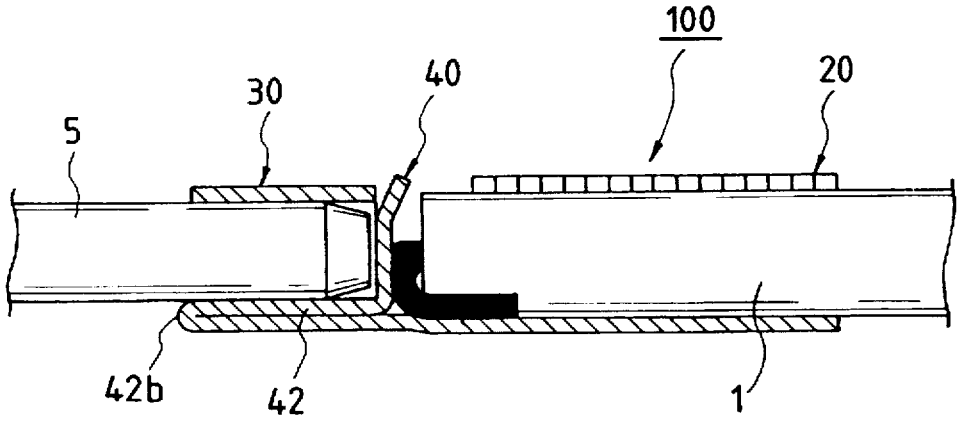
FIG. 3 is a longitudinal cross-sectional view showing the ignition cable connection terminal fitted on a mating terminal.

FIG. 1 is a partly-broken, perspective view of one embodiment of the ignition cable connection terminal of the invention, FIG. 2 is a developed view of a metal blank for forming the ignition cable connection terminal; and FIG. 3 is a longitudinal cross-sectional view of the ignition cable connection terminal fitted on a mating terminal.

In FIG. 1, an ignition cable connection terminal 100 connects an ignition cable 1 to a mating terminal 5 of a distributor (not shown), and this terminal 100 broadly includes a fixing portion 20 for clamping connection to the ignition cable 1, a tubular fitting portion 30 for fitting on the mating terminal 5, and a stopper piece portion 40 provided between the fixing portion 20 and the fitting portion 30 for abutment against a distal end of the ignition cable 1 to position the same in the axial direction.

As shown in FIG. 2, this connection terminal 100 is formed by bending a metal blank 50 of a predetermined shape blanked or stamped from an electrically-conductive metal sheet.

As shown in FIG. 2, a toothed or serrated portion 22 is formed on each of opposite side edges 21 of the fixing portion 20. A plurality of beads 23 are formed on and project from a central portion of the fixing portion 20. The fixing portion 20 is bent or curved into a generally circular shape, and then is clamped and fixed to the ignition cable 1 as shown in FIG. 1. In this condition, the toothed portions 22 bite into an insulation sheath of the ignition cable 1, and the beads 23 are positively pressed into contact with the ignition cable 1, thereby firmly holding the ignition cable 1.

Figure 7:
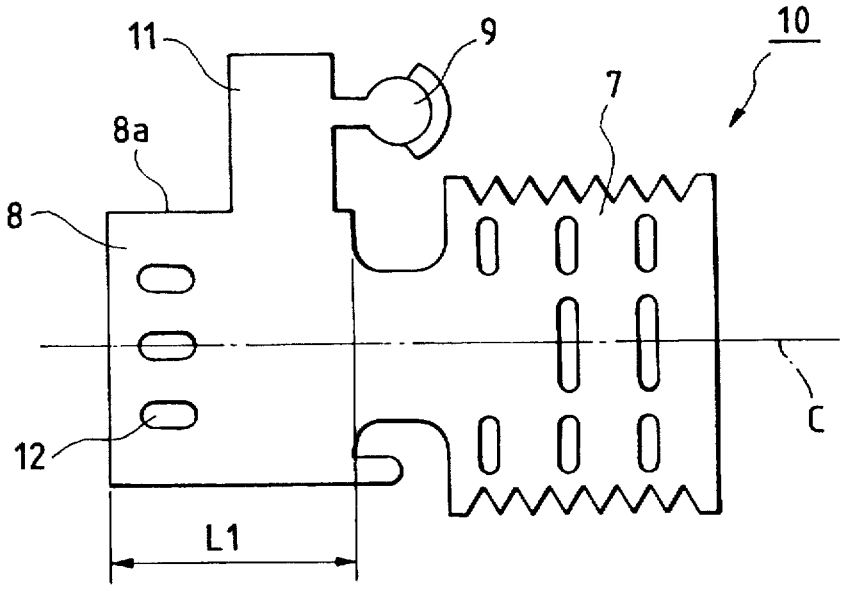
FIG. 7 PRIOR ART
FIG. 7 is a developed view of a metal blank for forming the ignition cable connection terminal of FIG. 6.

When the metal blank 50 is in its initial condition, the fitting portion 30 is flat and rectangular as shown in FIG. 2, and any portion corresponding to the contact beads 12 (see FIG. 7) of the conventional terminal is not formed on the fitting portion 30.

As shown in FIG. 2, the stopper piece portion 40 includes a body portion 41 for abutment against the distal end of the ignition cable, and a band-like connection portion 42 interconnecting the body portion 41 and the fitting portion 30.

Namely, the stopper piece portion 40 extends from the fitting portion 30, and when the metal blank 50 is in its initial condition, the connection portion 42 extends in the axial direction C from an edge 31 of the fitting portion 30 remote from the fixing portion 20, and the body portion 41 is formed at the distal end of the connection portion 42.

The metal blank 50 shown in FIG. 2 is bent by a plurality of pressing steps.

In this bending operation, the stopper piece portion 40 is first bent perpendicularly at the boundary between the body portion 41 and the connection portion 42, so that the body portion 41 is upstanding. Then, the connection portion 42 is bent or folded back through an angle of about 180° at its proximal end, disposed at the edge 31 of the fitting portion 30, to be laid flat against the surface of the fitting portion 30. Then, the fitting portion 30 is bent into a cylindrical shape, with its opposite side edges 32 butted against each other. At this time, the connection portion 42 is curved together with the fitting portion 30, so that its surface **42*a* is curved to form part of a cylindrical surface. The fixing portion 20 is bent or curved into a U-shaped cross-section. When fixing the ignition cable 1 to the connection terminal 100, the fixing portion 20 is compressed into a cylindrical shape to be fixedly clamped to the ignition cable 1**.

In the above bending process, a folded portion **42*b* of the connection portion 42 of the connection terminal 100 is rounded as shown in FIGS. 1 and 3, and when fitting the fitting portion 30 on the mating terminal 5, this rounded portion guides the insertion of the mating terminal 5. Therefore, the connection terminal 100 can be easily fitted on the mating terminal 5**.

When the fitting portion 30 is fitted on the mating terminal 5, the mating terminal 5 is held in contact with the surface **42*a* of the connection portion 42. Since the surface 42*a* is so curved as to form part of a cylindrical surface, the contact between the connection portion 42 and the mating terminal 5 is a surface-to-surface contact, and even if the cylindrical shape of the fitting portion 30** is slightly deformed, a good electrical connection is maintained.

Namely, because of the surface-to-surface contact of the connection portion 42 of the stopper piece portion 40 with the mating terminal 5, and also because of a spring action of the fitting portion 30 in the radial direction, the connection terminal 100 is characterized in that the provision of the contact beads on the conventional terminal can be omitted. As a result, the axial length L2 (<L1) of the fitting portion 30 can be reduced as shown in FIG. 2, and therefore the connection terminal 100 can be reduced in overall length to have a small-size design.

Although the preferred embodiment of the connection terminal 100 of the present invention has been described above, the present invention is not limited to the above embodiment, and various modifications can be made.

Figure 4:
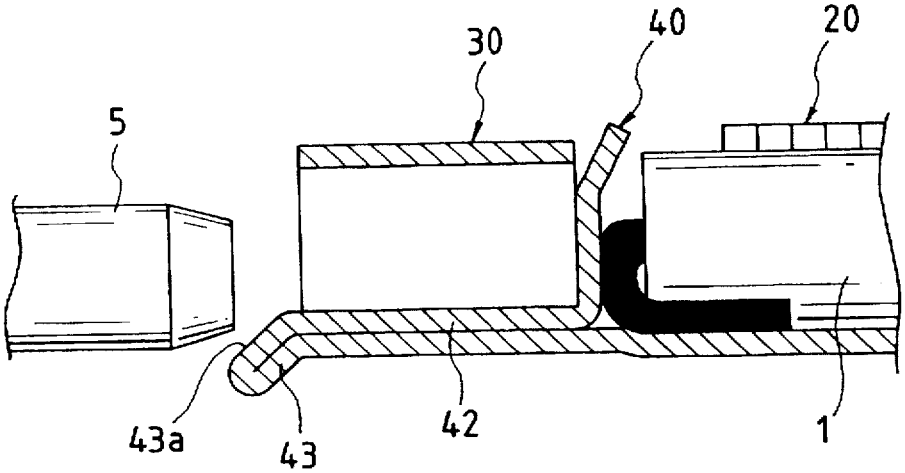
FIG. 4 is a longitudinal cross-sectional view of an important portion of another embodiment of an ignition cable connection terminal of the invention.
Figure 5:
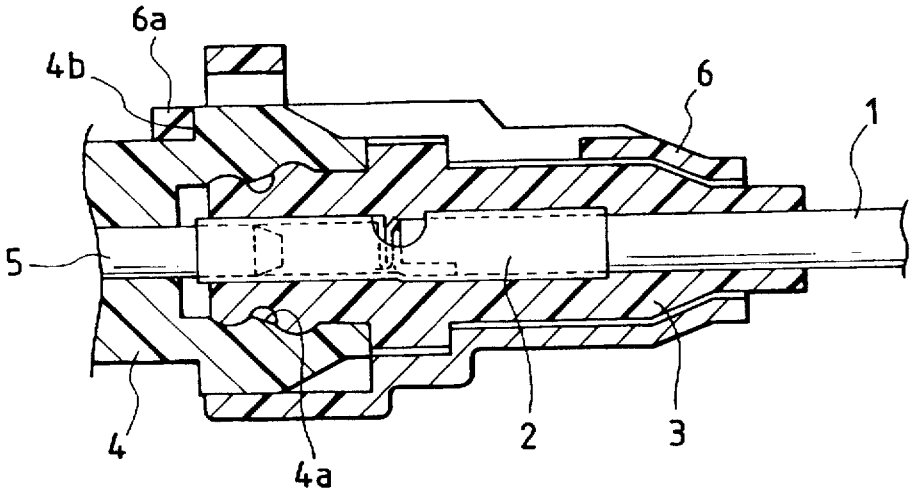
FIG. 5 PRIOR ART
FIG. 5 is a longitudinal cross-sectional view of a conventional construction, showing a condition of connection between a terminal of a distributor and an ignition cable.
Figure 6:
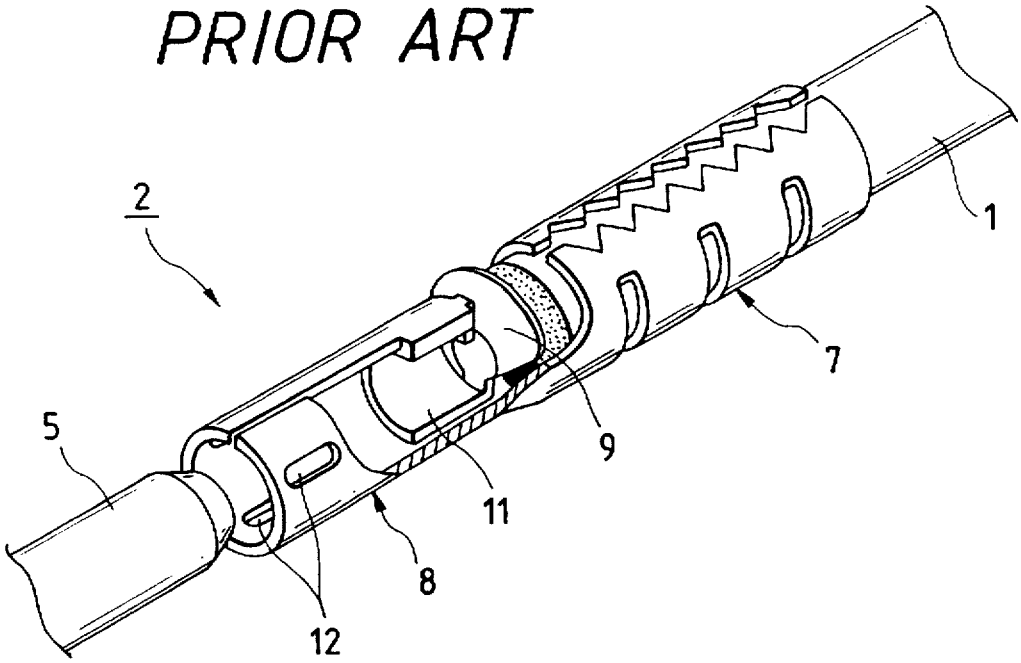
FIG. 6 PRIOR ART
FIG. 6 is a partly-broken, perspective view of the ignition cable connection terminal of FIG. 5.

For example, as shown in FIG. 4, the folded portion of the connection portion 42 may be formed into a tongue-like guide portion 43 having a downwardly-slanting surface 43*a*, and this slanting surface 43*a* guides the insertion of the mating terminal 5 into the fitting portion 30. With this construction, the connection terminal can be more easily fitted on the mating terminal 5.

As described above, in the present invention, any contact bead does not need to be formed on the fitting portion adapted to fit on the mating terminal, and therefore the axial length of the fitting portion can be reduced, and hence the connection terminal can be reduced in overall length to have a smaller-sized design.

With this smaller-sized design of the connection terminal, the cost of the material required for producing the terminal can be reduced, thereby lowering overall costs.

The connection portion of the stopper piece portion is brought into surface-to-surface contact with the mating terminal, and therefore a good electrical connection between the connection terminal and the mating terminal is maintained.

The folded portion of the connection portion guides the insertion of the mating terminal into the fitting portion, and therefore the connection terminal can be easily fitted on the mating terminal, thus enhancing the efficiency of the attaching operation, and also the distal end of the fitting portion is reinforced, thereby preventing deformation of the fitting portion.

What is claimed is:

1. An ignition cable connection terminal formed by bending a metal sheet blank stamped into a predetermined shape, the connection terminal comprising:

a fixing portion for a clamping connection to an ignition cable;

a tubular fitting portion for coupling with a mating terminal;

a stopper piece portion which is provided between the fixing portion and the fitting portion, and has a body portion for abutment against a distal end of the ignition cable;

wherein the stopper piece portion has a connection portion which extends in a direction of an axis of the connection terminal from an edge of the fitting portion remote from the fixing portion in an initial condition of the metal sheet blank, wherein the axis comprises a central axis of each of the stopper portion, the connection portion, the fitting portion, and the fixing portion, in succession, in the initial condition of the metal sheet blank and the body portion is formed at a distal end of the connection portion;

wherein the connection portion is folded back at its proximal end, disposed at the edge of the fitting portion, on an inner surface of the fitting portion bent into a cylindrical shape, and extends toward the fixing portion;

wherein a surface of the connection portion disposed within the fitting portion is formed into a curved surface for intimate contact with a peripheral surface of the mating terminal;

wherein a downwardly-slanting tongue-like guide portion for guiding insertion of the mating terminal into the fitting portion is formed at a folded portion of the connection portion; and wherein contact beads are formed only on the fixing portion.

2. The ignition cable connection terminal according to claim 1, wherein the downwardly-slanting tongue-like guide portion having a rounded leading edge.

3. An ignition cable connection terminal formed by bending a metal sheet blank stamped into a predetermined shape, the connection terminal comprising:

a fixing portion for a clamping connection to an ignition cable;

a tubular fitting portion for coupling with a mating terminal;

a stopper piece portion which is provided between the fixing portion and the fitting portion, and has a body portion for abutment against a distal end of the ignition cable;

wherein the stopper piece portion has a connection portion which extends in a direction of an axis of the connection terminal from an edge of the fitting portion remote from the fixing portion in an initial condition of the metal sheet blank, wherein the axis comprises a central axis of each of the stopper portion, the connection portion, the fitting portion, and the fixing portion, in succession, in the initial condition of the metal sheet blank and the body portion is formed at a distal end of the connection portion;

wherein the connection portion is folded back at its proximal end, disposed at the edge of the fitting portion, on an inner surface of the fitting portion bent into a cylindrical shape, and extends toward the fixing portion;

wherein contact beads are formed only on the fixing portion; and wherein the connection portion has a tongue-like guide portion, the tongue-like guide portion having a downwardly-slanting surface which facilitates the insertion of a mating terminal.

4. The ignition cable connection terminal according to claim 3, wherein the tongue-like guide portion is formed at a folded portion of the connection portion.

5. The ignition cable connection terminal according to claim 3, wherein a surface of the connection portion disposed within the fitting portion is formed into a curved surface for intimate contact with a peripheral surface of the mating terminal.

6. The ignition cable connection terminal according to claim 5, wherein the tongue-like guide portion having a rounded leading edge.

7. The ignition cable connection terminal according to claim 3, wherein the tongue-like guide portion having a rounded leading edge.

8. The ignition cable connection terminal according to claim 7, wherein the tongue-like guide portion is formed at a folded portion of the connection portion.

9. An ignition cable connection terminal formed by bending a metal sheet blank stamped into a predetermined shape, the connection terminal comprising:

a fixing portion for a clamping connection to an ignition cable;

a tubular fitting portion for coupling with a mating terminal;

a stopper piece portion which is provided between the fixing portion and the fitting portion, and has a body portion for abutment against a distal end of the ignition cable;

wherein the stopper piece portion has a connection portion which extends in a direction of an axis of the connection terminal from an edge of the fitting portion remote from the fixing portion in an initial condition of the metal sheet blank, wherein the axis comprises a central axis of each of the stopper portion, the connection portion, the fitting portion, and the fixing portion, in succession, in the initial condition of the metal sheet blank and the body portion is formed at a distal end of the connection portion;

wherein the connection portion is folded back at its proximal end, disposed at the edge of the fitting portion, on an inner surface of the fitting portion bent into a cylindrical shape, and extends toward the fixing portion; and wherein the connection portion has a tongue-like guide portion, the tongue-like guide portion having a downwardly-slanting surface which facilitates the insertion of a mating terminal.

10. The ignition cable connection terminal according to claim 9, wherein the tongue-like guide portion having a rounded leading edge.

11. The ignition cable connection terminal according to claim 9, wherein the tongue-like guide portion is formed at a folded portion of the connection portion.

12. The ignition cable connection terminal according to claim 11, wherein the tongue-like guide portion having a rounded leading edge.

13. The ignition cable connection terminal according to claim 11, wherein a surface of the connection portion disposed within the fitting portion is formed into a curved surface for intimate contact with a peripheral surface of the mating terminal.

14. The ignition cable connection terminal according to claim 13, wherein the tongue-like guide portion having a rounded leading edge.

15. The ignition cable connection terminal according to claim 9, wherein a surface of the connection portion disposed within the fitting portion is formed into a curved surface for intimate contact with a peripheral surface of the mating terminal.

16. The ignition cable connection terminal according to claim 15, wherein the tongue-like guide portion having a rounded leading edge.

* * * * *